US009810504B1

(12) United States Patent
LoRocco et al.

(10) Patent No.: US 9,810,504 B1
(45) Date of Patent: Nov. 7, 2017

(54) MULTIPURPOSE BRACKET ASSEMBLY FOR ARCHERY

(71) Applicant: TruGlo, Inc., Richardson, TX (US)

(72) Inventors: Paul LoRocco, Dallas, TX (US); John Estridge, Plano, TX (US); Damon Coalson, Dallas, TX (US); Greg Webb, Garland, TX (US)

(73) Assignee: TruGlo, Inc., Richardson, TX (US)

( * ) Notice: Subject to any disclaimer, the term of this patent is extended or adjusted under 35 U.S.C. 154(b) by 322 days.

(21) Appl. No.: 14/212,138

(22) Filed: Mar. 14, 2014

Related U.S. Application Data

(60) Provisional application No. 61/787,906, filed on Mar. 15, 2013.

(51) Int. Cl.
*F41B 5/00* (2006.01)
*F41B 5/14* (2006.01)

(52) U.S. Cl.
CPC ..... *F41B 5/14* (2013.01)

(58) Field of Classification Search
CPC ..... F41B 45/00; F41G 1/467; B26B 3/06
USPC ..... 124/88, 87; 30/155, 159, 160; 33/265; 343/702
See application file for complete search history.

(56) References Cited

U.S. PATENT DOCUMENTS 3,013,336 A 12/1961 Pennington
3,487,548 A 1/1970 Frydenlund
4,497,116 A 2/1985 Hawkins
4,541,179 A 9/1985 Closson
5,359,780 A 11/1994 Dallaire
5,442,862 A 8/1995 Newbold et al.
5,566,665 A * 10/1996 Stinson ..... F41B 5/066 124/25.7
5,651,185 A 7/1997 Vanderheyden et al.
5,720,270 A * 2/1998 Meicke ..... F41G 1/467 124/87
5,828,341 A * 10/1998 Delamater ..... G06F 1/1616 343/702
5,920,996 A 7/1999 Hurckman et al.
5,975,069 A 11/1999 Hamm et al.
6,079,111 A 6/2000 Williams et al.
6,134,794 A 10/2000 Raukola
6,505,407 B2 1/2003 Savage
6,796,039 B2 9/2004 Walbrink
6,868,614 B2 3/2005 Floied et al.
7,360,313 B1 4/2008 Hamm et al.
(Continued)

*Primary Examiner* — Aarti B Berdichevsky
*Assistant Examiner* — Christopher Glenn
(74) *Attorney, Agent, or Firm* — Alvin R. Wirthlin

(57) ABSTRACT

A bracket assembly for adjusting the elevation of a bowsight includes a first bracket portion and a second bracket portion spaced from the first bracket portion and adapted for connection to a bowsight. A first pivot arm extends between the first and second bracket portions and is connected thereto via first and second pivot joint assemblies, respectively. A second pivot arm extends between the first and second bracket portions and is connected thereto via third and fourth pivot joint assemblies, respectively. A range adjustment assembly is operably associated with one of the pivot arms and the first bracket portion to thereby cause pivoting movement of the first and second pivot arms and thus movement of the second bracket portion with respect to the first bracket portion to thereby adjust the elevation of a bowsight when connected to the second bracket portion.

18 Claims, 6 Drawing Sheets

(56) References Cited

U.S. PATENT DOCUMENTS

| | | | | |
|---|---|---|---|---|
| 7,475,485 | B1 | 1/2009 | Hamm et al. | |
| 7,513,050 | B2 | 4/2009 | Kroening, Jr. | |
| 7,584,543 | B1 | 9/2009 | Boyd | |
| 7,644,503 | B2 | 1/2010 | Lewis | |
| 7,721,453 | B1 | 5/2010 | Young | |
| 7,856,728 | B1 * | 12/2010 | Ozinga | F41G 1/467 124/87 |
| 8,607,460 | B1 * | 12/2013 | Lerch | B26B 3/06 30/155 |
| 2002/0112358 | A1 | 8/2002 | Savage | |
| 2004/0107587 | A1 | 6/2004 | Floied et al. | |
| 2008/0289201 | A1 * | 11/2008 | Kroening, Jr. | F41G 1/467 33/265 |
| 2011/0067682 | A1 | 3/2011 | Blosser et al. | |
| 2011/0271944 | A1 * | 11/2011 | Haney | F41G 1/467 124/87 |

* cited by examiner

MULTIPURPOSE BRACKET ASSEMBLY FOR ARCHERY

CROSS-REFERENCE TO RELATED APPLICATIONS

This application claims the benefit of U.S. Provisional Application No. 61/787,906 filed on Mar. 15, 2013, the disclosure of which is hereby incorporated by reference.

BACKGROUND OF THE INVENTION

This invention relates generally to accessories for archery bows, and more particularly to a bracket assembly for mounting a sighting device, quiver, and/or other accessories to an archery bow.

Prior art brackets for mounting a sighting device, quiver, or other accessory to an archery bow are typically very limited in their capacity to mount more than one accessory to the archery bow. For example, a bracket for mounting a bowsight may be completely independent of a bracket for mounting a quiver and thus are not interchangeable or useable together.

Moreover, certain bowsights with a single sight pin require an elevation adjustment mechanism for aiming at targets that may be located at different distances. Such mechanisms typically have pivot joints that are rough in operation. Consequently, obtaining the exact elevation of the pin can be difficult, especially when the archer is holding the bow in one hand and making the elevation adjustment with the other hand. In addition, these mechanisms usually have an adjustment wheel and a stationary locking feature associated with the wheel. During wheel adjustment, the locking feature can interfere with the fingers and/or thumb of the archer, thus making it difficult to quickly adjust the elevation of the sight pin to the desired location. During hunting when time is of the essence and an intended target may vanish, these disadvantages can mean the difference between an acquired target and a lost one.

BRIEF SUMMARY OF THE INVENTION

In accordance with one aspect of the invention, a bracket assembly for adjusting the elevation of a bowsight includes a first bracket portion; a second bracket portion spaced from the first bracket portion and adapted for connection to a bowsight; a first pivot arm extending between the first and second bracket portions and connected thereto via first and second pivot joint assemblies; a second pivot arm extending between the first and second bracket portions and connected thereto via third and fourth pivot joint assemblies; and a range adjustment assembly operably associated with one of the pivot arms and the first bracket portion to thereby cause pivoting movement of the first and second pivot arms and adjust the elevation of a bowsight.

A bracket assembly for adjusting the elevation of a bowsight includes a first bracket portion and a second bracket portion spaced from the first bracket portion and adapted for connection to a bowsight. A first pivot arm extends between the first and second bracket portions and is connected thereto via first and second pivot joint assemblies, respectively. A second pivot arm extends between the first and second bracket portions and is connected thereto via third and fourth pivot joint assemblies, respectively. A range adjustment assembly is operably associated with one of the pivot arms and the first bracket portion to thereby cause pivoting movement of the first and second pivot arms and thus movement of the second bracket portion with respect to the first bracket portion to thereby adjust the elevation of a bowsight when connected to the second bracket portion.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
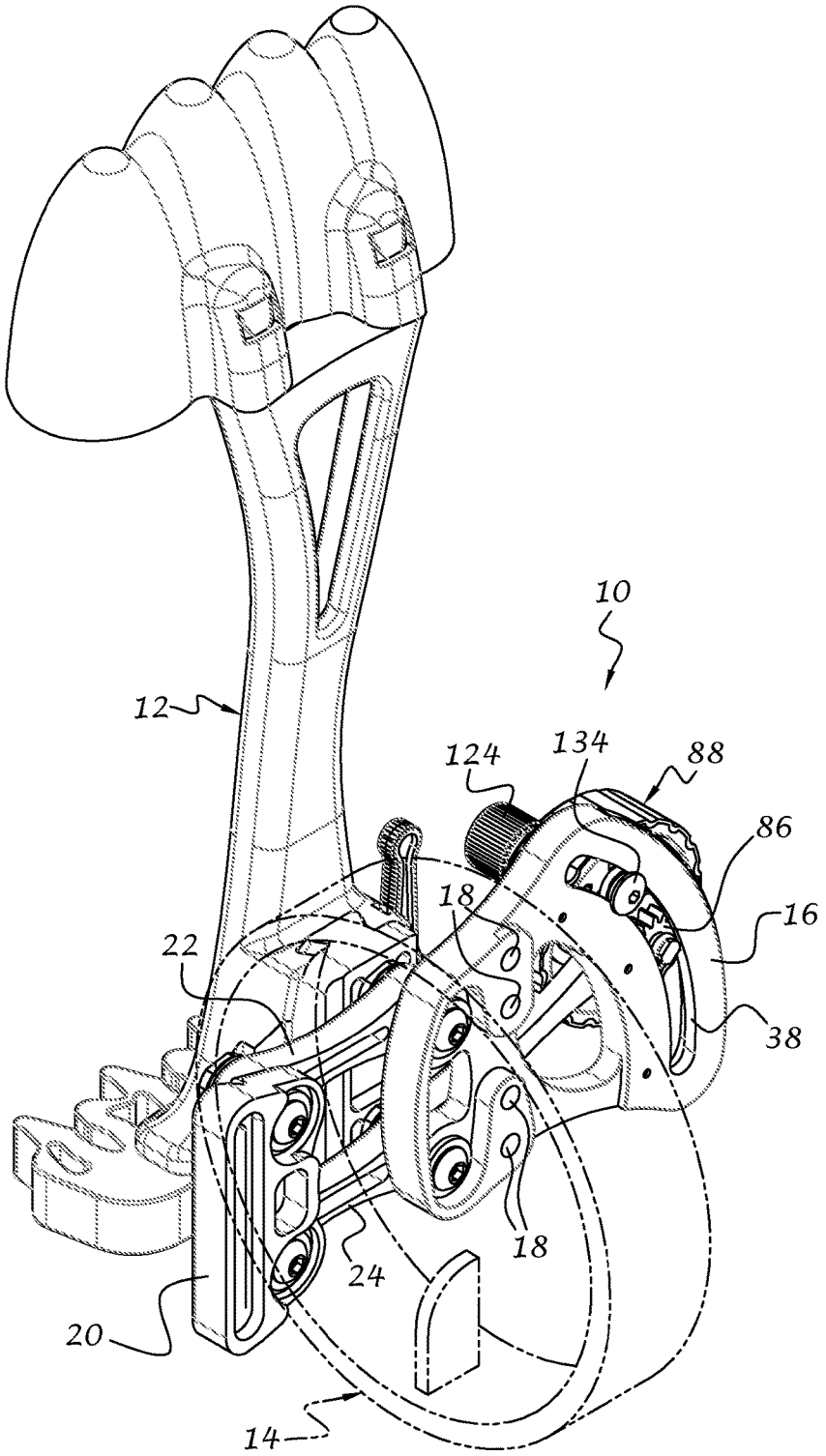
FIG. 1 is a left front isometric view of a bracket assembly for an archery bow with a quiver connected thereto in accordance with an exemplary embodiment of the present invention.
Figure 2:
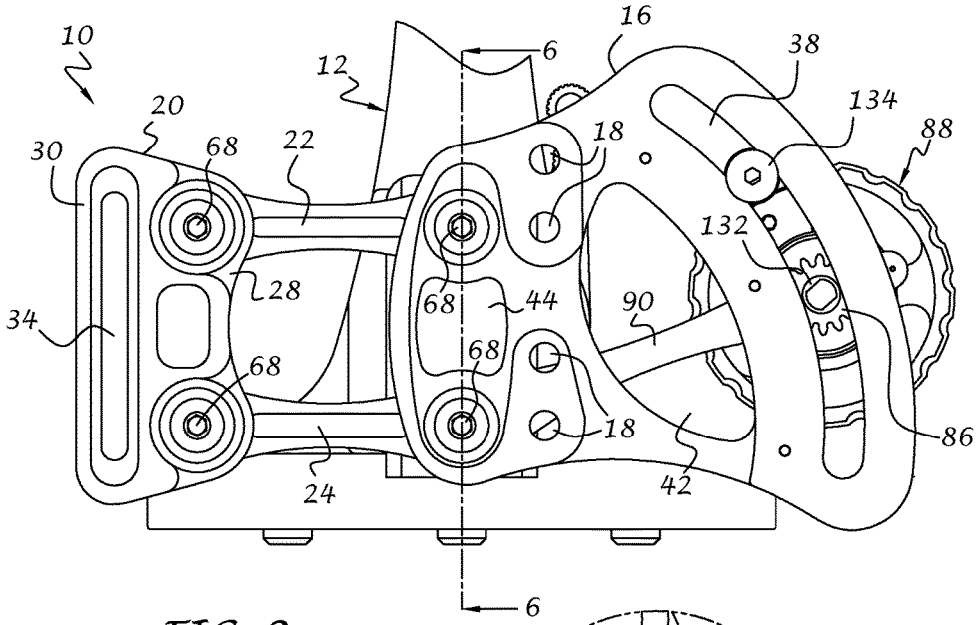
FIG. 2 is a left side elevational view thereof and showing a portion of the quiver.

Referring to the drawings, and to FIG. 1 in particular, a bracket assembly 10 in accordance with the present invention is illustrated. The bracket assembly 10 as shown is adapted for connection to the riser of an archery bow (not shown) and can receive archery accessories, such as a quiver 12 for holding arrows (not shown) and a sighting device 14 (shown schematically in phantom line). To this end, the bracket assembly 10 preferably includes a first bracket portion 16 with openings 18 formed therein for receiving fasteners (not shown) that thread into the bow structure in a conventional manner, and a range adjustment assembly 15 for adjusting the height of the sighting device 14. It will be understood that the bracket assembly 10 may be adapted for use with any projectile launching device where range adjustment is desirous, such as crossbows, rifles, and so on.

With additional reference to FIGS. 2-6, the bracket assembly 10 also preferably includes a second bracket portion 20 adapted for connection to the sighting device 14 (FIG. 1). A first pivot arm 22 and a second pivot arm 24 are pivotally connected to the first bracket portion 16 and second bracket portion 20 via pivot joint assemblies 26 to thereby form a four-bar linkage. Each pivot joint 26 is preferably similar in construction, as will be described in detail below. The second bracket portion 20 can be of any suitable shape for connection to the sighting device 14, either directly or indirectly, through well-known windage adjustment mechanisms (not shown). Accordingly, the second bracket portion 20 preferably includes a plate portion 28 and a dovetail portion 30 extending forwardly of the plate portion. Pivot openings 32 (FIG. 5) are formed in the plate portion 28 for receiving the pivot joint assemblies 26. A slot 34 is formed in the dovetail portion 30 so that a windage adjustment mechanism or the like can be adjustably connected thereto.

The first bracket portion 16 is preferably formed as a generally flat, plate-like structure and includes pivot openings 36 for receiving the pivot joint assemblies 26 and an arcuate slot 38 located rearwardly thereof for connection to the range adjustment assembly 15. The first bracket portion 16 can be provided with other and large openings 42 and 44 for reducing the weight of the first bracket portion 16.

As best shown in FIGS. 4-6, and 8, each pivot joint assembly 26 preferably includes a bushing 46 with a head portion 47 and a shank portion 49 that extends from the head portion and through one of the openings 48 in the first pivot arm 22 or one of the openings 50 in the second pivot arm 24. The openings 48, 50 are preferably countersunk to provide a slanted engagement surface or seat 52. A first bearing washer 54 has a central bore 55 that receives the shank portion 49 of the bushing 46. The first bearing washer 54 has a frustoconical surface 56 that normally rests against the seat 52 when assembled. A bore 60 extends through each bushing 46 and includes first inner threads 58 formed in the shank portion 49 and second inner threads 62 formed in the head portion 47 and shank portion 49. A threaded fastener 64 engages the first inner threads 58 for securing the pivot arms to the bracket portions. A washer 66 is preferably sandwiched between the head 68 of the fastener 64 and the first bracket portion 16 or second bracket portion 20 (depending on the location of the pivot joint assembly 26). A second bearing washer 70 is also preferably located between the first pivot arm 22 or second pivot arm 24 and the first bracket portion 16 or second bracket portion 20 (depending on the location of the pivot joint assembly 26) so that the pivot arms can rotate with respect to the bracket portions.

During assembly, in accordance with one embodiment of the invention, the first bearing washer 54 is installed on the shank portion 49 of the bushing 46 and the shank portion is inserted through one of the openings 48, 50 of the pivot arms 22, 24, respectively. The second bearing washer 70 is then installed on the shank portion 49. The shank portion is then inserted through one of the pivot openings 32, 36 of the bracket portions 16, 20, respectively. The washer 66 is then installed on the fastener 64 and the fastener is threaded into the first inner threads 58 of the shank portion 49. The slanted engagement surface 52 of the openings 48, 50 combined with the frustoconical shape of the first bearing washer 54 eliminates lateral movement of the joint while allowing adjustment of the force needed to rotate the pivot arms, even with loose tolerances between the components of the joint assembly.

In accordance with a further embodiment of the invention, the bushing 46 can be assembled with the first bearing washer 54, pivot arm 22 or 24 and second bearing washer. The shank 49 of the bushing 46 can then be press-fit into one of the pivot openings 32 or 36 so that the bushing 46 does not rotate with respect to its associated bracket portion. With this arrangement, the fastener 64 and washer 66 are no longer needed.

Figure 4:
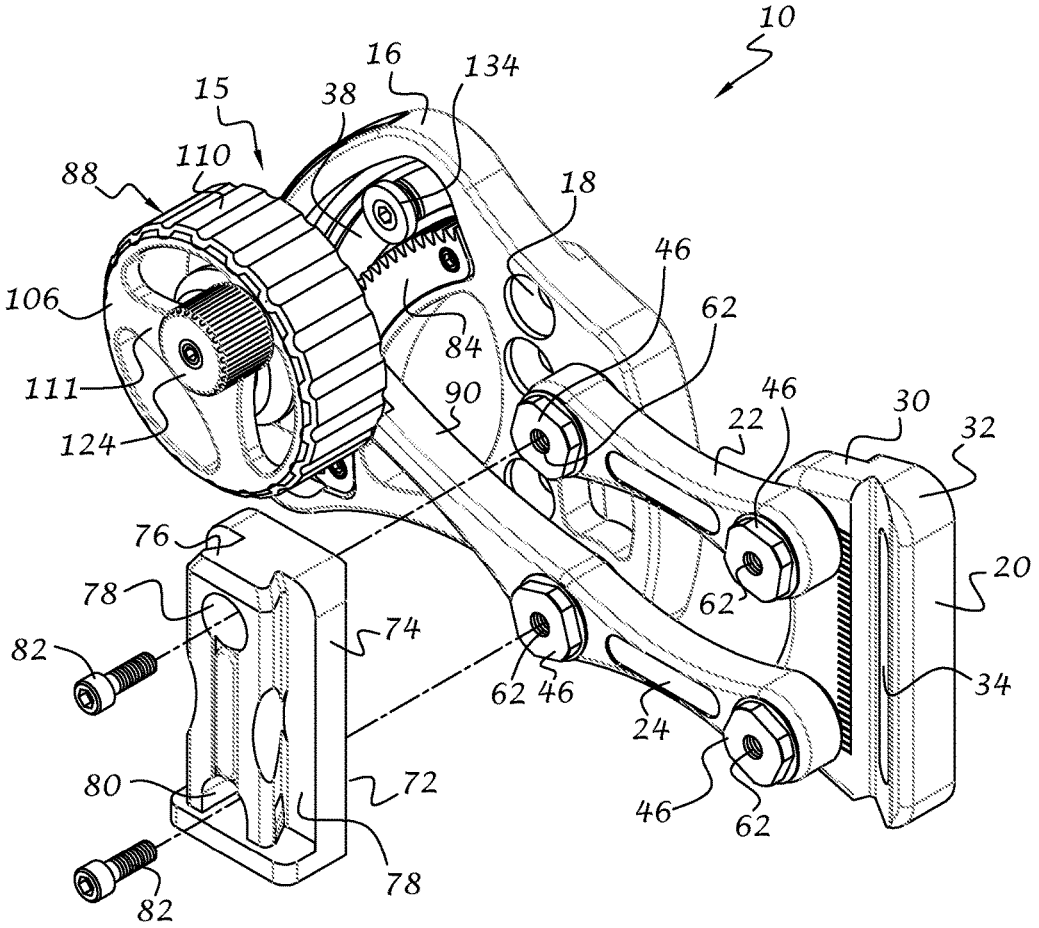
FIG. 4 is a right front isometric exploded view of the bracket assembly and illustrating the manner in which a quiver component is connected thereto.
Figure 6:
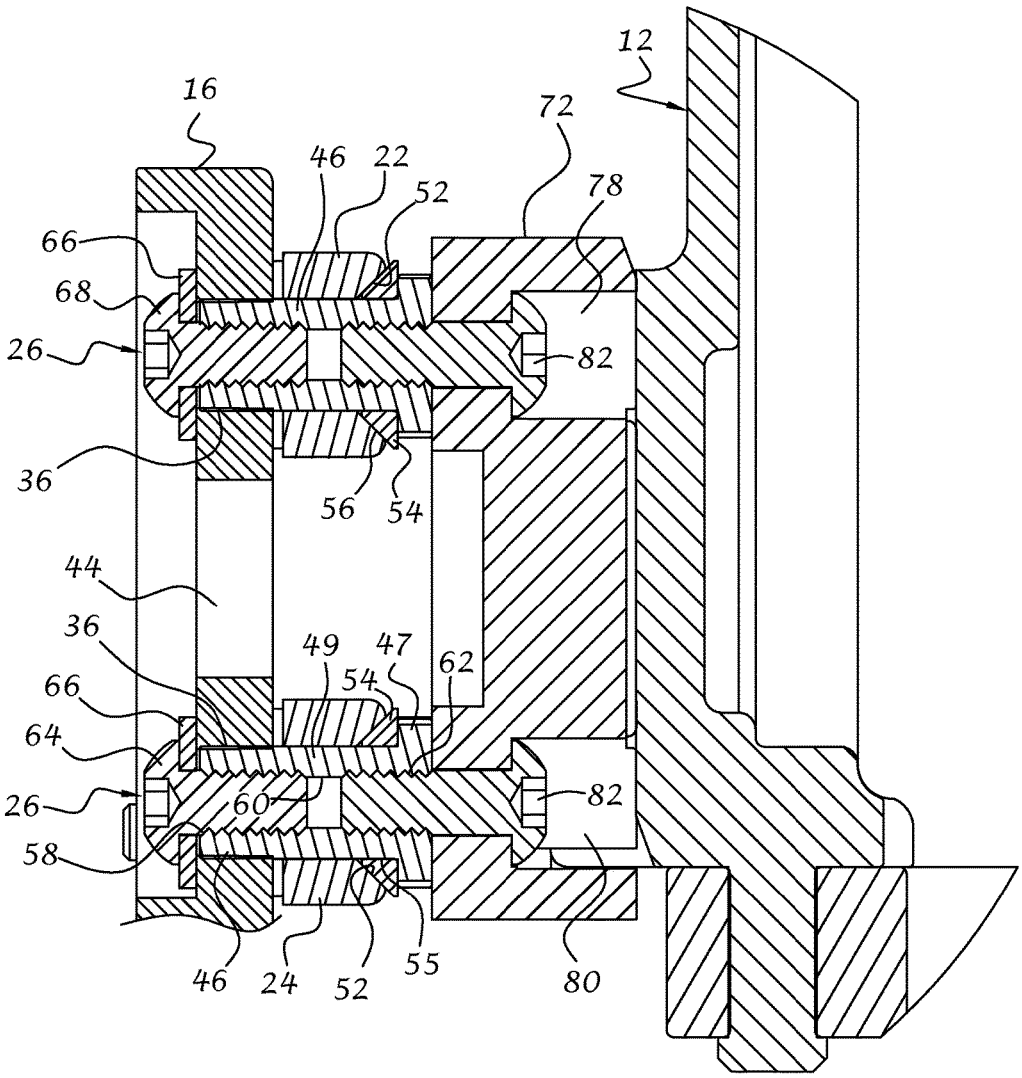
FIG. 6 is a sectional view of the bracket assembly and a portion of the connected quiver taken along line 6-6 of FIG. 2.

As best shown in FIGS. 4 and 6, the second inner threads 62 can advantageously be used to mount the quiver 12 to the bracket assembly 10. As shown, a releasable locking member 72 associated with the quiver 12 includes an elongate base 74 and a dovetail-shaped projection 76 that extends along the length of the base portion from a front face 34 thereof. The projection 74 is adapted to engage a dovetail-shaped groove (not shown) of the quiver 12 so that the quiver can be releasable mounted to the bracket assembly 10 (and thus an archery bow or the like) without the need to remove the locking member 72. A first opening 78 and a second opening 80 extend through the locking member 72 and are sized to receive threaded fasteners 82, which are in turn threaded into the second inner threads 62 of the bushings 46, for connecting the releasable locking member 26 (and thus the quiver 12) to the bracket assembly 10. The locking member 72 can be connected to either the rear pivot joint assemblies associated with to the first bracket portion 16 or the front pivot joint assemblies associated with the second bracket portion 20. Further details of the quiver 12 and releasable locking member 72 can be found in U.S. Patent Application No. 61/788,017 filed on Mar. 15, 2013, the disclosure of which is hereby incorporated by reference. It will be understood, however, that other quivers and/or quiver mounting arrangements can be installed at the pivot joints without departing from the spirit and scope of the invention.

Figure 3:
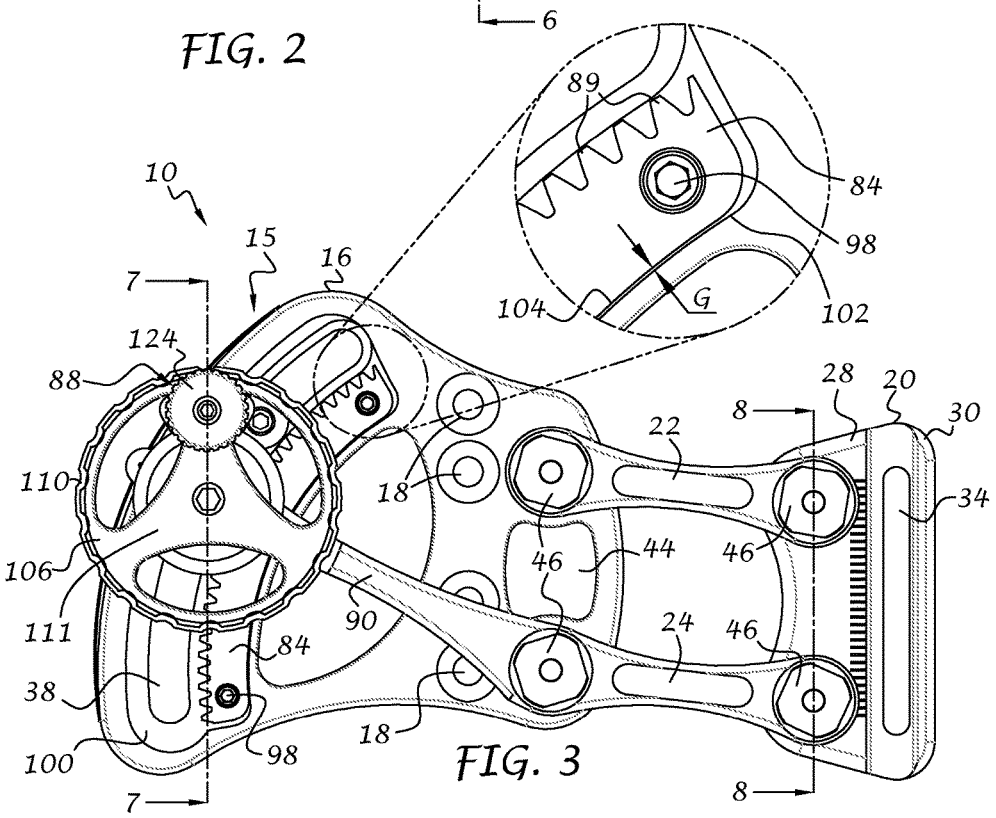
FIG. 3 is a right side elevational view of the bracket assembly with an enlarged detailed view.
Figure 5:
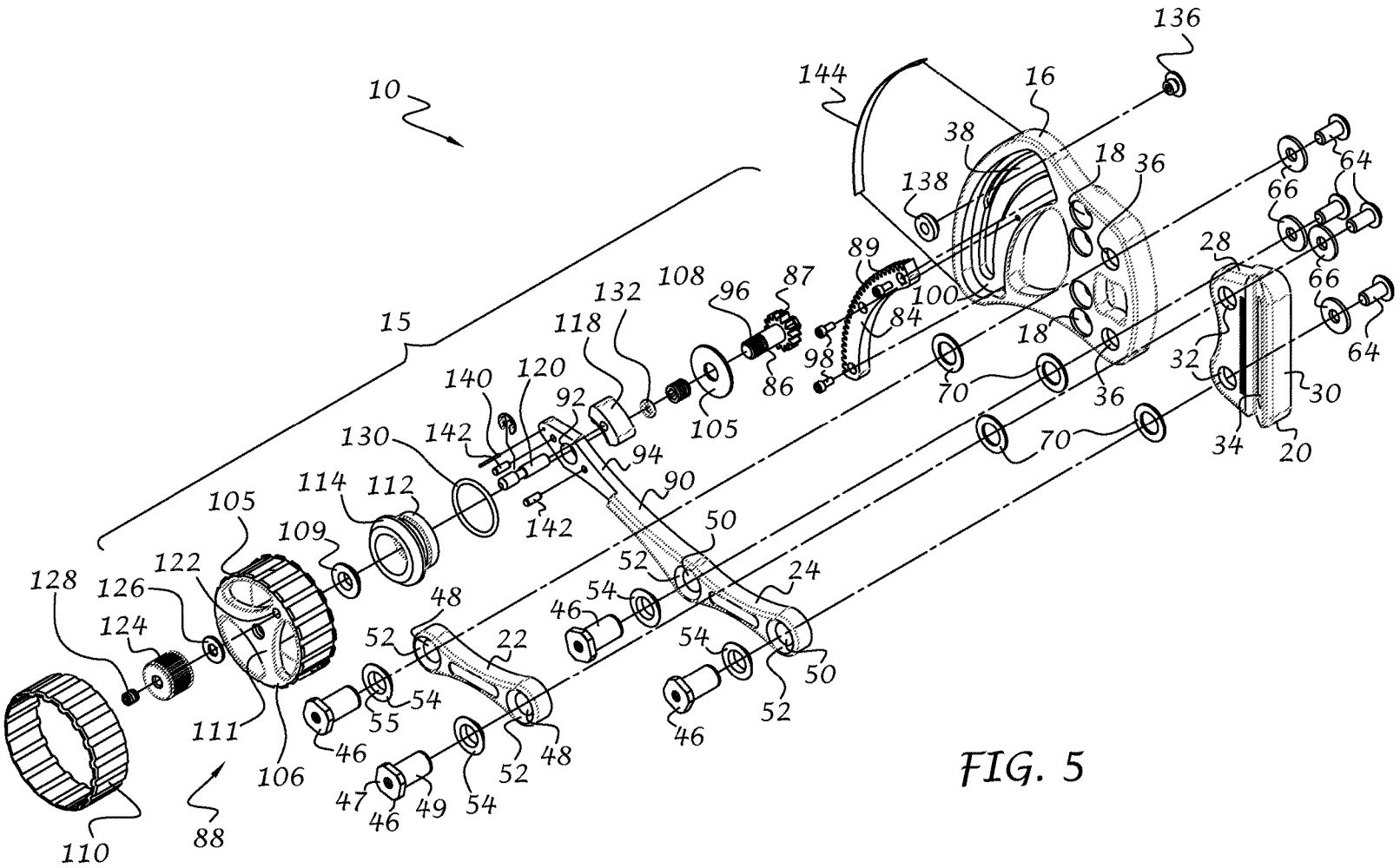
FIG. 5 is an exploded isometric view of the bracket assembly.
Figure 7:
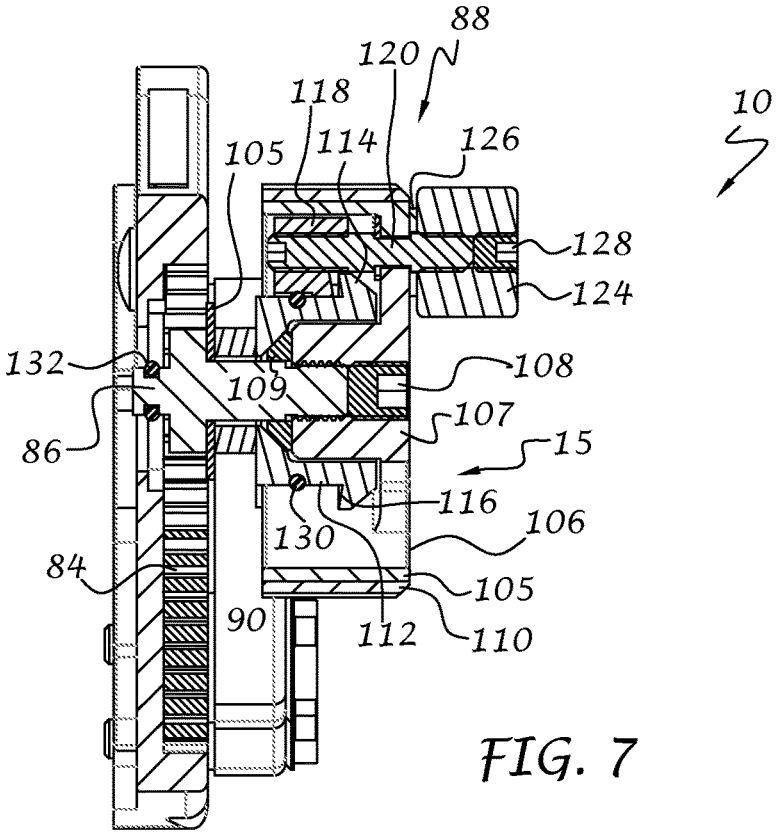
FIG. 7 is a section view of the bracket assembly taken along line 7-7 of FIG. 3.
Figure 8:
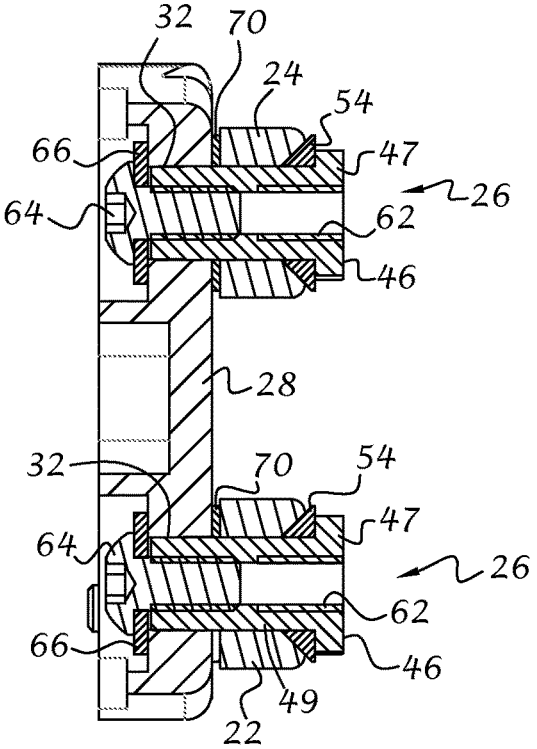
FIG. 8 is a section view of the bracket assembly taken along line 8-8 of FIG. 3.

Turning now to FIGS. 3, 5 and 7, the range adjustment assembly 15 preferably includes a first gear 84 with teeth 89 connected to the first bracket portion 16, a second gear 86 with teeth 87 that engage the teeth 89 of the first gear 84, and a drive wheel assembly 88 connected to the second gear 86 for rotation therewith. The second pivot arm 24 includes an extension section 90 with an opening 92 formed at an outer free end 94 thereof for receiving a shaft 96 of the second gear 88 such that the shaft 96 rotates within the opening 92 during pivotal movement of the second pivot arm 24.

The first gear 84 is preferably arcuate in shape and is located in a depression 100 of the first bracket portion 16 adjacent to the arcuate slot 38. Fasteners 98 extend through the first gear 84 and thread into the first bracket portion 16 to connect the first gear to the first bracket portion. As best shown in FIG. 3, a gap G between an edge 102 of the depression 100 and an edge 104 of the first gear 84. In this manner, the first gear 84 can be adjusted with respect to the travel pathway of the second gear 86 even with slight deviation from the pathway due to tolerance and manufacturing variations.

The drive wheel assembly 88 preferably includes a wheel 106 with an outer ring 105 connected to a hub 107 (FIG. 7) via a spoke section 111. The hub 107 is preferably connected to the shaft 96 via a threaded connection. The outer free end 94 of the extension section 90 is preferably sandwiched between the wheel 106 and the second bracket portion 20. A flat bearing washer 105 is preferably located between the extension section 90 and the first bracket portion 16. A set screw 108 also threads into the hub 107 for locking the shaft 96 to the hub so that the wheel 106 and shaft rotate together. The wheel 106 is adapted for manipulation for a user during range adjustment. Accordingly, an annular grip 110 can be attached to, or formed on, the wheel 106 to facilitate manipulation by the user. A drum 112 is also located on the shaft 96 within the wheel 106 and surrounds the hub 107. The drum 112 preferably includes an annular flange 114 with an angled braking surface 116. A bearing washer 109, preferably frustoconical in shape, is located between the drum 112 and hub 107.

A brake 118 is positioned next to the braking surface 116 for movement toward the braking surface when it is desirous to lock the wheel 106 against rotation, and movement away from the braking surface when it is desirous to unlock the wheel 106. To that end, a shaft 120 is connected to the brake 118, preferably via a threaded connection, and extends through an aperture 122 in the spoke section 111 for threaded engagement with a lock knob 124. A bearing washer 126 is preferably sandwiched between the lock knob 124 and the spoke section 111 to facilitate movement. A set screw 128 is also threaded into the lock knob 124 to ensure that the shaft 120 does not rotate with respect to the lock knob. An O-ring 130 preferably surrounds the drum 112 and is positioned between the brake 118 and the drum 112 to prevent relative radial movement therebetween. An O-ring 132 is also preferably mounted on the shaft 120 at an opposite end from the lock knob 124. The O-ring 132 absorbs vibration when the shaft 120 reaches the end of the arcuate slot 38 of the first bracket portion 16. Anti-rotation pins 142 are connected to the outer free end 94 of the extension section 90 on either side of the brake 118 and to the drum 112 to thereby fix the drum to the pivot arm 24, thereby preventing the brake and drum from rotation with the wheel 106.

In use, when it is desirous to adjust the elevation of the sighting device 14 (FIG. 1) for a target that may be located at a particular distance from the archer, the lock knob 124 is loosened and the wheel is rotated by the thumb and/or finger of the archer. As the wheel rotates, the second gear will travel along the first gear, thereby causing the pivot arms 22, 24 to rotate to either raise or lower the second bracket portion 20, and thus the connected sighting device 14. The lock knob 124 can then be tightened to draw the brake 118 against the angled brake surface 116 to thereby lock the wheel, and thus the first and second bracket portions, against movement.

An adjustable stop 134 can also be provided in the arcuate slot 38 for limiting the range of movement of the second gear with respect to the first gear and thus the range of movement of the sighting device 14. The adjustable stop 134 preferably includes a threaded fastener 136 located on one side of the arcuate slot 138 and a threaded washer 138 located on the opposite side thereof that threads onto the fastener 136.

A distance strip 144 (FIG. 5) can also be provided for attachment to the first bracket 16 for use in conjunction with a pointer 140 that extends through the extension section 90. The strip 144 can be a separate layer, or integrally formed, so that the archer can quickly adjust the elevation of the sighting device 14 to a predetermined level.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. A bracket assembly for adjusting the elevation of a bowsight, the bracket assembly comprising:

a first bracket portion;

a second bracket portion spaced from the first bracket portion and adapted for connection to a bowsight;

a first pivot arm extending between the first and second bracket portions and connected thereto via first and second pivot joint assemblies, respectively;

a second pivot arm extending between the first and second bracket portions and connected thereto via third and fourth pivot joint assemblies, respectively;

each pivot joint assembly comprising:

a first pivot opening formed in each pivot arm;

a second pivot opening formed in each bracket portion in alignment with the first pivot opening;

a slanted engagement surface associated with one of the first and second pivot openings, the slanted engagement surface forming a seat;

a bushing having a head portion, a shank portion extending from the head portion and first inner threads formed in the bushing; the shank portion extending through the first and second pivot openings so that the pivot arm and bracket portion mutually rotate about the shank portion;

a bearing washer having a frustoconical surface located on the shank portion of the bushing, with the frustoconical surface adjustably engaging the seat of the first pivot opening such that the slanted engagement surface of the first pivot opening engages the frustoconical surface of the bearing washer with adjustable frictional force to thereby vary a force required for mutual rotation of the pivot arm and bracket;

a first fastener having a fastener head and a threaded portion extending from the fastener head, with the fastener head pressing against one of the bracket and bearing washer, and the head portion of the bushing pressing against the other of the bracket and the bearing washer, with the threaded portion of the fastener engaging the first inner threads of the bushing;

wherein tightening the fastener causes the head portion of the bushing to draw towards the fastener head thereby pressing the frustoconical surface of the bearing washer against the slanted engagement surface of the seat while sandwiching the bracket and the pivot arm therebetween, while and varying the frictional force therebetween and thus the force required for mutual rotation of the pivot arm and bracket portion, even with loose tolerances in the pivot joint assembly.

2. A bracket assembly for adjusting the elevation of a bowsight, the bracket assembly comprising:

a first bracket portion;

a second bracket portion spaced from the first bracket portion and adapted for connection to a bowsight;

a first pivot arm extending between the first and second bracket portions and connected thereto via first and second pivot joint assemblies, respectively;

a second pivot arm extending between the first and second bracket portions and connected thereto via third and fourth pivot joint assemblies, respectively;

a range adjustment assembly operably associated with one of the pivot arms and the first bracket portion to thereby cause pivoting movement of the first and second pivot arms and movement of the second bracket portion with respect to the first bracket portion to thereby adjust the elevation of a bowsight when connected to the second bracket portion;

at least the second and fourth pivot joints being spaced from each other a predetermined distance and being stationary with respect to the first bracket portion;

mechanical fastening elements associated with the second and fourth pivot joints for connecting a quiver mounting portion thereto; and a quiver mounting portion connectable to the second and fourth pivot joints such that the quiver mounting portion is stationary with respect to the first bracket portion independent of movement of the second bracket portion.

3. A bracket assembly according to claim 2, wherein the mechanical fastening elements comprise internal threads formed in at least the second and fourth pivot joints and threaded fasteners that extend through mounting holes in the quiver mounting portion, the mounting holes being aligned with the second and fourth pivot joints such that the threaded fasteners mesh with the internal threads to thereby secure the quiver mounting portion to the bracket assembly.

4. A bracket assembly for adjusting the elevation of a bowsight, the bracket assembly comprising:

a first bracket portion;

a second bracket portion spaced from the first bracket portion and adapted for connection to a bowsight;

a first pivot arm extending between the first and second bracket portions and connected thereto via first and second pivot joint assemblies, respectively;

a second pivot arm extending between the first and second bracket portions and connected thereto via third and fourth pivot joint assemblies, respectively; and a range adjustment assembly operably associated with one of the pivot arms and the first bracket portion to thereby cause pivoting movement of the first and second pivot arms and movement of the second bracket portion with respect to the first bracket portion to thereby adjust the elevation of a bowsight when connected to the second bracket portion; wherein the range adjustment assembly comprises:

a first elongate gear connected to the first bracket portion;

a second gear that meshes with the first elongate gear;

an adjustment wheel operably associated with the second gear to thereby rotate the second gear with respect to the first elongate gear; and a brake assembly operably associated with the adjustment wheel to prevent movement thereof, the brake assembly including:

a lock knob rotatably connected to the adjustment wheel for manipulation by a user, the lock knob being rotatably connected to the adjustment wheel at a location spaced from an axial center of the adjustment wheel;

a drum connected to the adjustment wheel for rotation therewith, the drum having a braking surface; and a brake operatively associated with the lock knob such that rotation of the lock knob causes the brake to press against the braking surface of the drum, thereby locking the drum and the adjustment wheel against movement, and thus the first and second bracket portions, against relative movement.

5. A bracket assembly according to claim 4, wherein the first elongate gear is adjustable with respect to the first bracket portion to thereby prevent binding of the first elongate gear with the second gear.

6. A bracket assembly according to claim 4, wherein the first elongate gear follows an arcuate pathway.

7. A bracket assembly according to claim 4, wherein each pivot joint assembly comprises: a bushing having a shank portion; a bearing washer with a frustoconical shape installed on the shank portion; the shank portion of the bushing and the first bearing washer being installed in a first pivot opening of one of the pivot arms so that the one pivot arm rotates with respect to the shank portion; and the bushing extending into a second pivot opening of one of the bracket portions and secured such that the bushing is stationary with respect to the one bracket portion.

8. A bracket assembly according to claim 7, wherein the first opening comprises a slanted surface for engaging the frustoconical shape of the bearing washer such that lateral movement of the pivot joint is at least substantially reduced while allowing adjustment of a force needed to rotate the pivot arms, even with loose tolerances in the joint assembly.

9. A bracket assembly according to claim 7, wherein the bushing comprises internal threads for connecting an archery accessory thereto.

10. A bracket assembly according to claim 9, wherein the archery accessory comprises at least one of a quiver and a quiver mount.

11. A bracket assembly according to claim 1, and further comprising a range adjustment assembly operably associated with one of the pivot arms and the first bracket portion to thereby cause pivoting movement of the first and second pivot arms and movement of the second bracket portion with respect to the first bracket portion to thereby adjust the elevation of a bowsight when connected to the second bracket portion.

12. A bracket assembly according to claim 1, wherein the bushing comprises second internal threads for connecting an archery accessory thereto.

13. A bracket assembly according to claim 12, wherein the archery accessory comprises at least one of a quiver and a quiver mount.

14. A bracket assembly according to claim 3, and further comprising a quiver connectable to the quiver mounting portion.

15. A bracket assembly according to claim 14, wherein the quiver and the quiver mounting portion have mutually engageable surfaces to thereby facilitate connection of the quiver to the quiver mounting portion.

16. A bracket assembly according to claim 15, wherein the mutually engageable surfaces comprise a dovetail-shaped groove on one of the quiver mounting portion and the quiver and a dovetail-shaped projection on the other of the quiver mounting portion and the quiver for engaging the dovetail-shaped groove so that the quiver is slidably connected to the quiver mounting portion.

17. A bracket assembly according to claim 1, wherein a slanted engagement surface is associated with the first pivot opening.

18. A bracket assembly according to claim 17, wherein the fastener head presses against the bracket portion, and the head portion of the bushing pressing against the bearing washer such that the bracket portion and pivot arm are sandwiched between the fastener head and the head portion of the bushing.

* * * * *